US005911287A

United States Patent [19]

Campbell

[11] Patent Number: 5,911,287

[45] Date of Patent: Jun. 15, 1999

[54] LIFTING DEVICE FOR USE WITH A LADDER

[76] Inventor: Ronald L. Campbell, P.O. Box 5674, Shasta Lake, Calif. 96089

[21] Appl. No.: 08/997,759

[22] Filed: Dec. 24, 1997

[51] Int. Cl.[6] ..... E04G 1/08

[52] U.S. Cl. ..... 182/103; 182/214; 182/241

[58] Field of Search ..... 182/103, 129, 182/214, 101, 102, 141; 187/241

[56] References Cited

U.S. PATENT DOCUMENTS

| | | | |
|---|---|---|---|
| 156,541 | 11/1874 | Conrad . | |
| 319,119 | 6/1885 | Pentz . | |
| 2,526,071 | 10/1950 | Estey . | |
| 3,666,054 | 5/1972 | Ellings et al. . | |
| 4,183,423 | 1/1980 | Lewis . | |
| 4,491,196 | 1/1985 | Bockey . | |
| 4,546,853 | 10/1985 | Hanson . | |
| 5,275,256 | 1/1994 | Ellzey . | |
| 5,743,356 | 4/1998 | Mitchell | 182/214 |

*Primary Examiner*—Alvin Chin-Shue
*Attorney, Agent, or Firm*—Theodore J. Bielen, Jr.

[57] ABSTRACT

A lifting device for raising a load intended for support by a roof of a building utilizing a ladder. Device includes a sled having first portion for slidingly contacting the ladder and a second portion providing a platform for a load. The sled is movable along the ladder generally in an up and down direction. A brace member connects to the ladder end, adjacent the roof. The brace possesses a flange which contacts the roof. An arm rotatably connects to the brace. The brace arm includes a first support surface for the sled when the arm is rotated toward the roof and a second support surface for contacting the roof. The sled is motivated along the ladder by motivating mechanism such as a crank operated cable.

5 Claims, 3 Drawing Sheets

LIFTING DEVICE FOR USE WITH A LADDER

BACKGROUND OF THE INVENTION

The present invention relates to a novel lifting device for raising a load onto the roof of a building utilizing a ladder.

Many items of material and equipment must be lifted onto the roof portion of a building. For example, roof tiles, air conditioning units, fans, and the like are normally placed on the top surface of the roof of a building. In the past, lifting devices such as cranes, cherry pickers, helicopters, and the like have been employed to accomplish this task. Although successful in lifting such loads, these items of equipment require multiple persons and are quite expensive to operate.

Several systems have been proposed for use with ladders for the purpose of lifting loads onto a roof. For example, U.S. Pat. No. 5,275,256 depicts a ladder carriage apparatus in which a pair of floor plates are connected to a side plate that is lifted up and down the ladder by a pulley.

U.S. Pat. Nos. 3,666,054, 4,183,423, and 4,546,853 show dollies or sleds that are lifted up the side rungs of a ladder by using a pulley system. Presumptively, when the load reaches the top of the ladder someone on the roof is required to lift the load from the platform to bring it onto the roof. The systems depicted in these patents normally would require at least two persons to move loads up and down a ladder onto a roof of a building.

A load lifting system used in conjunction with the ladder to move the load to the roof of a building that can be operated by a single person would be a notable advance in the art of materials transportation.

SUMMARY OF THE INVENTION

In accordance with the present invention a novel and useful lifting device for raising a load onto a roof is herein provided.

The device of the present invention employs a sled having a first portion for slidingly contacting the ladder, particularly the rails of the ladder extending between the rungs. The first portion may include guides which rest against the rails of the ladder for this purpose. The sled also is provided with a second portion having a platform for the load. Such platform may take the form of an outwardly extending plate angularly attached to the first portion of the sled. Of course, straps or other holders may be employed to further secure the load to the sled.

The lifting device also is constructed with a brace member that is connected to the ladder portion adjacent the roof of the building. The brace member includes a flange which extends outwardly to contact the roof. Such flange may also be articulated and possesses a toe in order to rest squarely on the roof top surface. The brace further possesses fastening means for holding the brace member to the rails or upright sides of the ladder. Such fastening means may be formed with a pair of sides that overlap the rails of the ladder. In addition, a bar and an opposing plate connect to the pair of sides of the fastening means and span the end of the ladder to form a cavity. The end of the ladder wedges in the cavity and normally extends a short distance above the edge of the roof when the device of the present invention is being employed.

The lifting device of the present invention is also provided with an arm as one of its elements. The arm is rotatably connected to the brace and includes a support surface for the sled. The arm includes another support surface to contact the roof. The roof contacting support surface may take the form of a foot which extends from the arm. The arm may be connected to the bar of the brace which spans the sides thereof.

In addition, motivating means is also found in the present device for sliding the sled upwardly along the ladder and onto the first support surface of the arm in order to effect rotation of the arm relative to the brace. This motivating means may take the form of a motorized mechanism, or, simply, a cable and crank arrangement for manual lifting. In this regard, the line or cable may be attached to the sled and include a crank which is attached to the arm. Thus, the user may turn the crank while standing on the roof surface.

It may be apparent that a novel and useful lifting device for raising a load to a roof utilizing a ladder has been described.

It is therefore an object of the present invention to provide a lifting device for raising a load to a roof in conjunction with a ladder which is simple to manufacture and use.

Another object of the present invention is to provide a lifting device for raising a load to a roof utilizing a ladder which may be operated by a single person.

A further object of the present invention is to provide a lifting device for raising a load to a roof in conjunction with a ladder that is safe to operate.

Yet another object of the present invention is to provide a lifting device for raising a load to a roof in conjunction with a ladder that is economical, since such use of the device saves time and requires a minimum of persons to operate.

Another object of the present invention is to provide a lifting device for raising a load to a roof in conjunction with a ladder that is easily adaptable to ladders of existing construction.

The invention possesses other objects and advantages especially as concerns particular characteristics and features thereof which will become apparent as the specification continues.

The invention possesses other objects and advantages especially as concerns particular characteristics and features thereof which will become apparent as the specification continues.

DETAILED DESCRIPTION OF THE PREFERRED EMBODIMENTS

Various aspects of the present invention will evolve from the following detailed description of the preferred embodiments which should be compared and referenced to the hereinabove described drawings.

Figure 1:
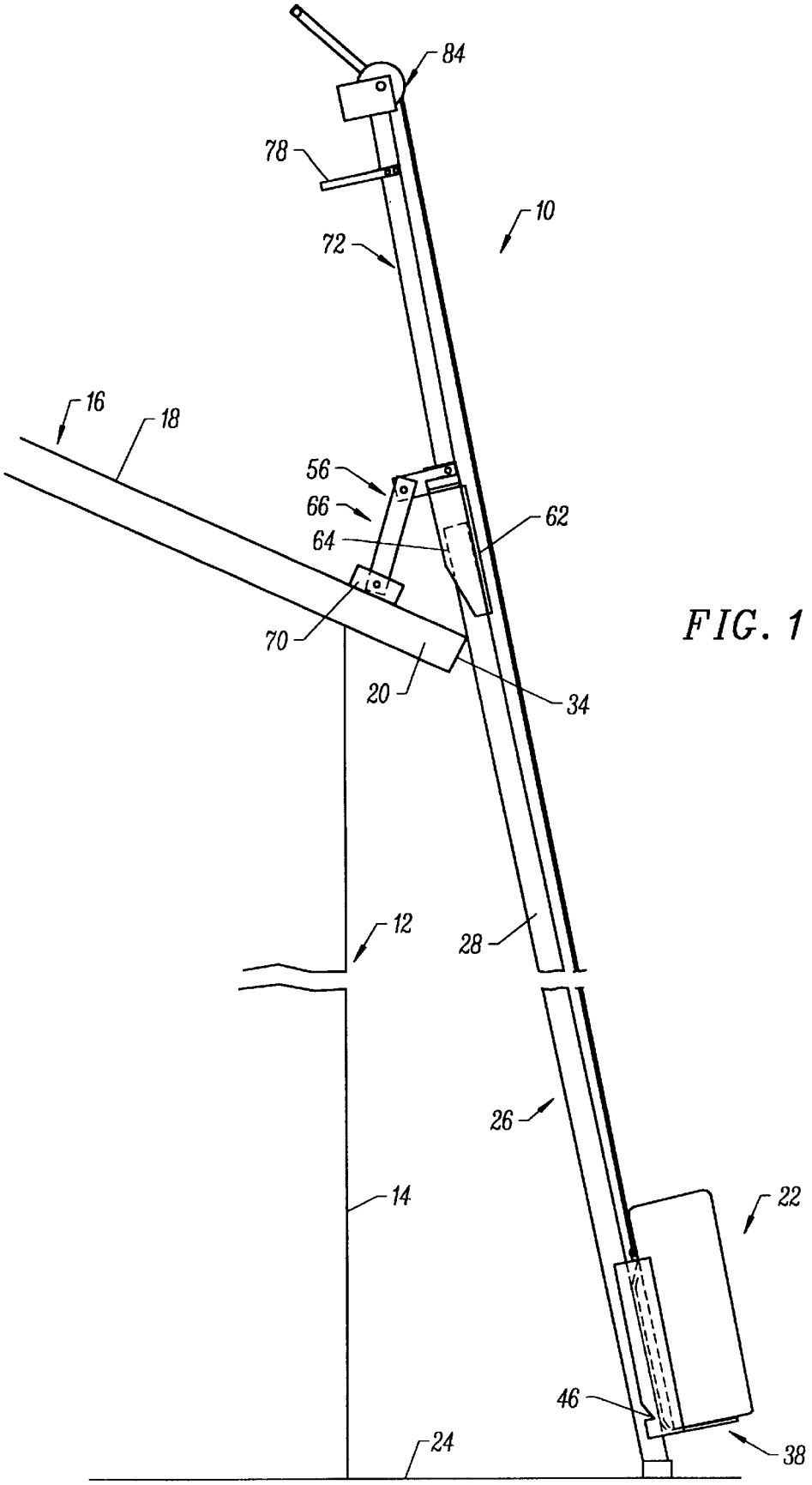
FIG. 1 is a side elevational view of the device of the present invention in place relative to a roof of a building.
Figures 4, 5:
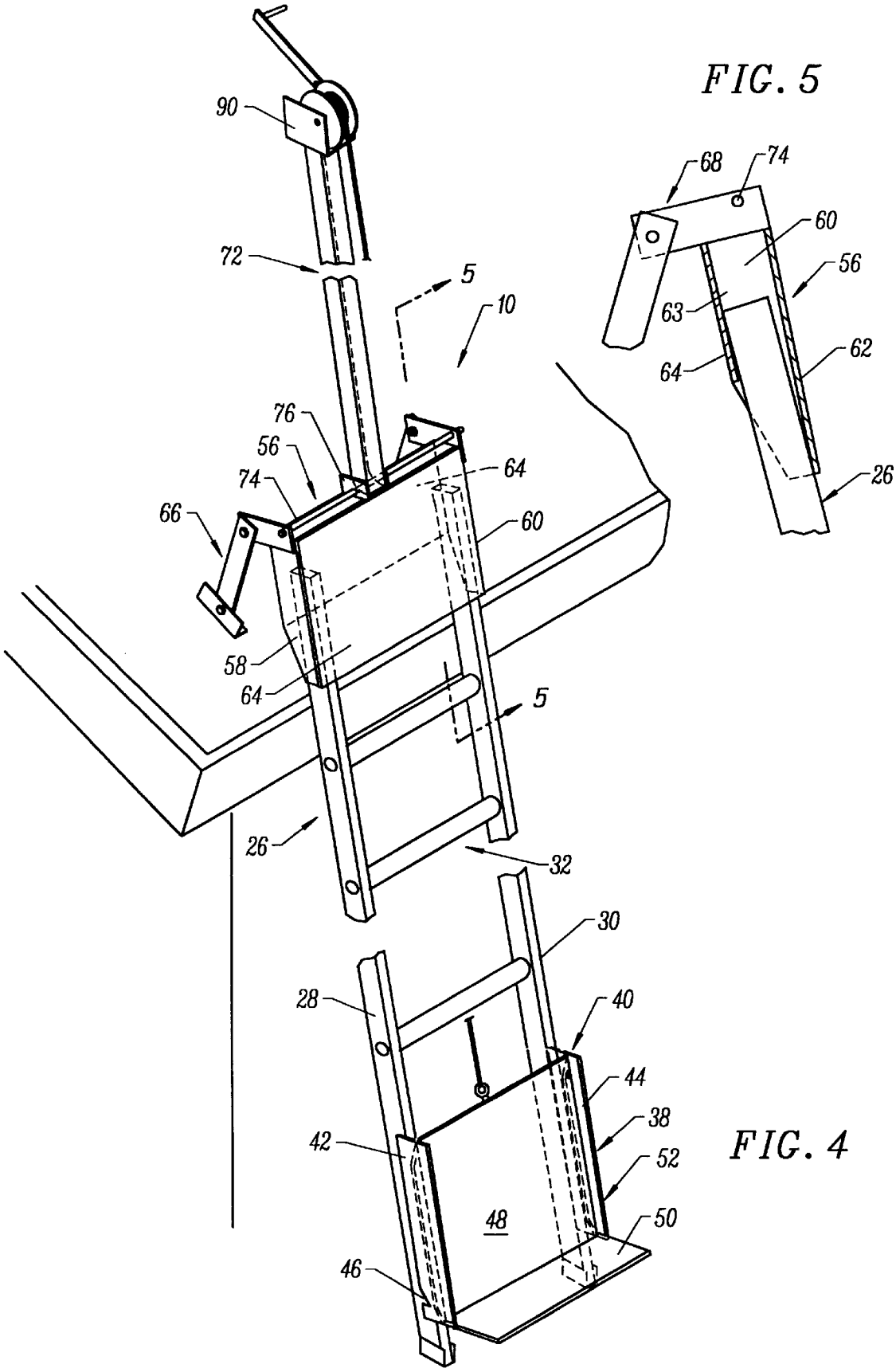
FIG. 4 is a left side, top perspective view of the device of the present invention, placed relative to a roof, showing the rotatable arm in broken configuration.
FIG. 5 is a sectional view along line 5—5 of FIG. 4.

The invention as a whole is shown in the drawings by reference character 10. Device 10, FIGS. 1 and 4, is used in conjunction with a building 12 having a wall portion 14 and a pitched roof 16. Roof 16 includes an upper surface 18 and a cantilevered portion or eave 20. Device 10 is employed to lift a load 22 from ground surface 24 to surface 18 of roof 16. Load 22 may take the form of any items such as roofing tiles, patching material, air conditioning units, fans, and the like. Ladder 26, of conventional configuration, includes a pair of side rails 28 and 30 and a plurality of rungs 32 which lie across rails 28 and 30 and are connected thereto, best depicted in FIG. 4. Typically, rails 28 and 30 lean toward and rest on the edge 34 of facia 36 along eave 20 of roof 16.

Device 10 of the present invention includes as one of its elements a sled 38. Sled 38 is formed with a first portion 40 for contacting the rails 28 and 30 of ladder 26. First portion 40 may take the form of plates 42 and 44. Plates 42 and 44 each include a notch, notch 46 of plate 42, being illustrated on FIG. 4. A similar notch on plate 44 exists (not shown). Sled 38 also possesses a back member 48 and a platform 50 connected thereto. Thus, an L-shaped second portion 52 of sled 38 is formed for carrying load 22. It should be noted that the width of back plate 48 is sufficient to permit plates 42 and 44 to ride along rails 28 and 30 of ladder 26 along with the back plate 48. Eye 54 connects to back plate 48.

The invention also includes a brace member 56 which is connected to ladder 26 adjacent to roof 16. Brace 56 is formed with trapezoidal side members 58 and 60 and a spanning plate 62. Plate 62 lies opposite a distending top bar or plate 64, which again spans the distance between rails 28 and 30 of ladder 26, to form a cavity 63. Brace member 56 includes a pair of articulated legs or flanges 66 and 68 each articulated leg includes a toe portion, such as toe 70 of articulated leg 66. Toe 70 is also rotatable or articulated relative to the remainder of articulated leg 66.

Arm 72 is also found in the present invention and is pivotally or rotatably attached to brace 56. Specifically, rod 74 spans articulated legs 66 and 68, and also serves as a pivot for arm 72. Bracket 76 attaches to plate 62 to provide strength to rod 74 on either side of arm 72. Arm 72 also possesses a foot 78 which is capable of contacting roof surface 18 when arm 78 is rotated downwardly, FIG. 3. Upper surface 80 of arm 78 is capable of supporting load 22 when load 22 rests thereupon.

Motivating means 82 is illustrated in the present invention as a manual crank 84 with a cable 86 connected to sled 38 at eye 54. Crank 84 may be left or right handed. It should be understood that other types of motivating means may be employed such as pulleys, motorized hoists, and the like. Crank 84 is fixed to the end 88 of arm 72 by a bracket 90. Handle or other appurtenances may be found on arm 72 to steady the same during the operation of crank 84.

Figure 2:
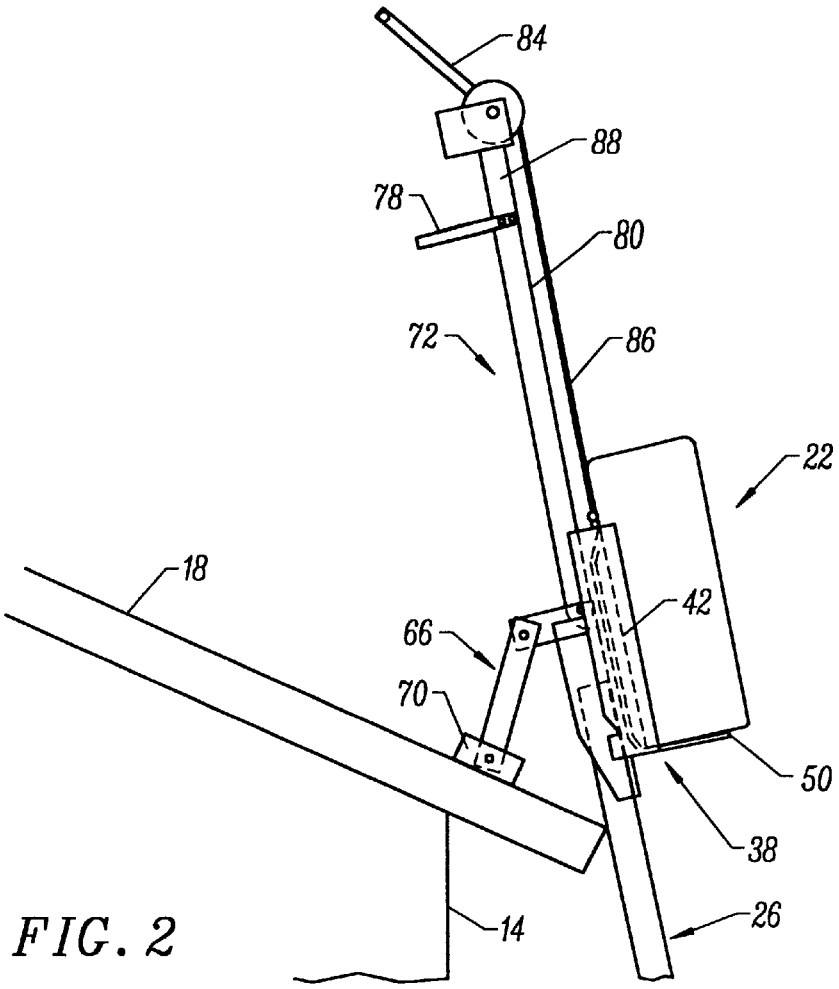
FIG. 2 is a side elevational view of the upper portion of the device of the present invention lifting a load above the roof line of the building.
Figure 3:
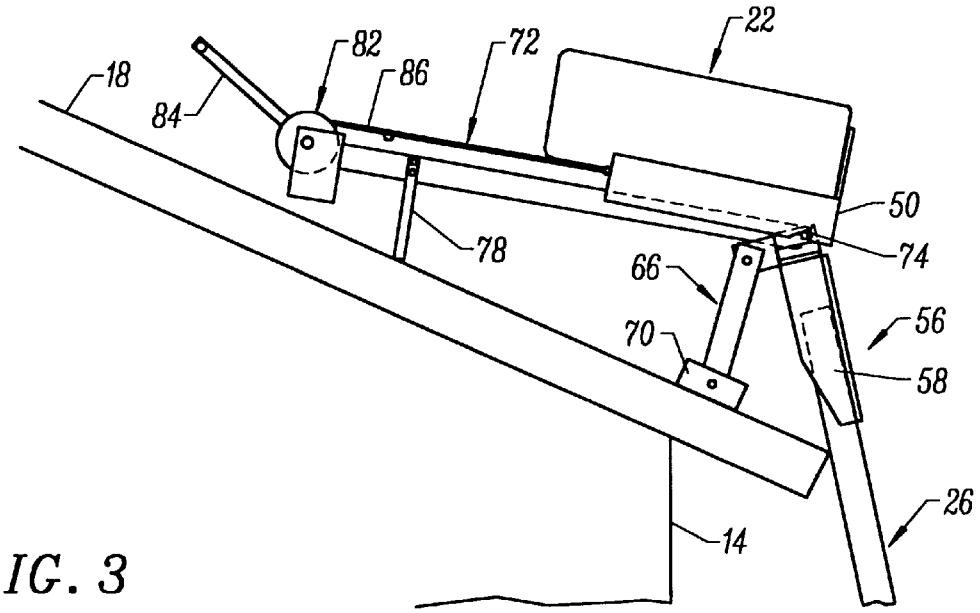
FIG. 3 is a side elevational view of the device of the present invention in which the arm support has been rotated onto the roof by the weight of the load.

In operation, the user places load 22 on sled 38 platform 50. The load 22 is then secured in some manner by straps, ropes, bands, and the like in the usual manner. Brace 56 is placed over the top of ladder 26 such that ladder 26 extends part way along sides 58 and 60 in cavity 63 of brace 56 and wedges between plates 62 and 64, FIG. 5. Articulated legs 66 and 68 are extended from brace 56 to permit the toes, such as toe 70, to lie flat on surface 18 of roof 16. At this point, arm 72 extends outwardly. Cable 86, attached to sled 38, is then tensioned by the turning of the crank 84. At this point, load 70 and sled 38 travel upwardly along the side rails 28 and 30 of ladder 26 to a point shown in FIG. 2. Arm 72 is then rotated downwardly such that foot 78 contacts roof surface 18 as depicted in FIG. 3. Load 22 is then also rotated or turned to a nearly horizontal position. Sled 38 is now resting on surface 80 of arm 72 and the top bar 74 of brace 56. Notches of plates 42 and 44, such as notch 46, engage the end portions of rod 74 to stop the forward movement of sled 38. Load 22 may then be lifted from the sled 38 and positioned at the proper place on surface 18 of roof 16.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A lifting device for raising a load intended for support by a roof of a building utilizing a ladder, comprising;

a. a sled having a first portion for slidingly contacting the ladder, and a second portion providing a platform for the load, said sled being movable along the ladder;

b. a brace member, said brace member including fastening means for holding said brace member to the rails of the ladder, said fastening means including at least a first plate, an opposite second plate, both said first and second plates having a width at least equal to the width of the ladder and forming a cavity between said first and second plates, the ladder being held in said cavity by wedging between said first and second plates, said brace member being connected to the ladder rails, by said wedging, adjacent the roof of the building, said brace further including a flange for contacting the roof;

c. an arm rotatably connected to said brace, said arm including a first support surface for said sled and a second support surface for contacting the roof; and d. motivating means for sliding said sled along the ladder and onto said first support surface of said arm to effect rotation of said arm relative to said brace, said motivating means comprising a line connected to said sled, and a crank for winding said line to lift said sled along the ladder and onto said first support surface of said arm, said crank fixed to said arm at a place beyond the position of the sled on said first support surface of said arm.

2. The device of claim 1 in which said motivating means further comprises mounting means for locating said motivating means to said arm.

3. The device of claim 2 which said second support surface of said arm further comprises a foot extending from said arm, said foot contacting the roof when said arm is rotated.

4. The device of claim 1 in which said flange for contacting the roof comprises a first flange and said brace further comprises a second flange for contacting the roof.

5. The device of claim 1 in which said flange articulates relative to said brace.

* * * * *